US011345513B2

(12) United States Patent
Alberti

(10) Patent No.: US 11,345,513 B2
(45) Date of Patent: May 31, 2022

(54) SELECTIVELY REMOVABLE WALL PORTABLE CONTAINER ASSEMBLY AND METHOD OF USE

(71) Applicant: Bianca Rachel Alberti, Cooper City, FL (US)

(72) Inventor: Bianca Rachel Alberti, Cooper City, FL (US)

( * ) Notice: Subject to any disclaimer, the term of this patent is extended or adjusted under 35 U.S.C. 154(b) by 88 days.

(21) Appl. No.: 16/284,467

(22) Filed: Feb. 25, 2019

(65) Prior Publication Data

US 2020/0270024 A1 Aug. 27, 2020

(51) Int. Cl.

| | |
|---|---|
| ***B65D 43/12*** | (2006.01) |
| ***B65D 21/02*** | (2006.01) |
| ***B65D 43/20*** | (2006.01) |
| ***B65D 25/54*** | (2006.01) |
| ***B65D 25/08*** | (2006.01) |
| ***B65D 43/02*** | (2006.01) |
| *B65D 25/28* | (2006.01) |
| *B65D 25/00* | (2006.01) |

(52) U.S. Cl.

CPC ..... *B65D 25/08* (2013.01); *B65D 43/0212* (2013.01); *B65D 25/005* (2013.01); *B65D 25/282* (2013.01); *B65D 2543/0062* (2013.01); *B65D 2543/00537* (2013.01)

(58) Field of Classification Search

CPC .. A47B 87/0276; A47B 87/0292; B65D 1/22; B65D 21/0219; B65D 25/08; B65D 25/282; B65D 25/38; B65D 25/005; B65D 2543/00537; B65D 2543/0062; B65D 43/0212; B65D 5/16; B65D 7/40; B65D 43/20

USPC ..... 220/4.31, 4.32, 555, 558, 729, 561, 220/345.1; 229/122, 125.12, 122.24, 229/162.1; 217/15, 47, 59, 62; 312/107.5, 111, 219, 107, 108; 206/772

See application file for complete search history.

(56) References Cited

U.S. PATENT DOCUMENTS 85,647 A * 1/1869 Dolan ..... E05G 1/00 109/64
170,441 A * 11/1875 Francis ..... A45C 11/20 206/544
RE7,371 E * 10/1876 Maginn ..... 229/125.19
(Continued)

*Primary Examiner* — Gideon R Weinerth
(74) *Attorney, Agent, or Firm* — Mark C. Johnson; Johnson Dalal

(57) ABSTRACT

A selectively removable wall portable container assembly that includes a portable container body and a detachable lid capable of selectively removably coupling to one another and achieving a retained configuration. The portable container body includes a bottom wall coupled to sidewall enclosing the bottom wall, defining a container cavity. The sidewall defines a front opening spatially coupled to the container cavity and includes a selectively removable sidewall portion that superimposes the front opening and is operably configured to translate along a sidewall translation path. The assembly achieves an encapsulated configuration wherein the container cavity is encapsulated by the lid, bottom wall, and sidewall. Further, the assembly achieves a container cavity access configuration wherein the lid is coupled to the container body and the sidewall portion is at least partially slidably removed from the sidewall, exposing the front opening.

13 Claims, 11 Drawing Sheets

(56) References Cited

U.S. PATENT DOCUMENTS 214,867 A * 4/1879 Hermann ..... B65D 43/12 206/267
264,383 A * 9/1882 Weiner ..... A47B 67/02 312/310
466,479 A * 1/1892 Winchester ..... B65D 5/16 229/122
1,158,558 A * 11/1915 Rosenfeld ..... B65D 5/16 229/122
1,840,561 A * 1/1932 Bre Miller ..... B65B 3/006 220/345.1
2,087,496 A * 7/1937 Beasley ..... B65D 43/20 217/15
2,478,470 A * 8/1949 Eastman ..... B65D 53/06 220/729
2,537,299 A * 1/1951 Brady ..... B65D 25/38 217/19
3,630,344 A * 12/1971 Bergh ..... A45C 11/34 220/345.2
3,851,938 A 12/1974 McCowan et al.
3,966,072 A 6/1976 Gonzalez et al.
3,997,055 A * 12/1976 Box ..... B65D 1/22 206/427
4,113,225 A * 9/1978 Corse ..... A21B 3/13 D7/354
4,162,024 A 7/1979 Shanley
4,322,118 A 3/1982 Shugart
4,387,512 A * 6/1983 Gorski ..... G01F 19/007 206/443
4,660,725 A * 4/1987 Fishman ..... A47B 87/02 206/278
4,819,829 A 4/1989 Rosten et al.
4,982,843 A * 1/1991 Jones ..... A61B 50/362 220/345.2
5,183,177 A 2/1993 Yu
D334,453 S 3/1993 Koloski
5,285,900 A * 2/1994 Swingler ..... B65D 25/005 206/425
5,400,914 A * 3/1995 Lin ..... B65D 43/20 220/254.9
5,605,246 A * 2/1997 Rausch, Sr. ..... B65D 25/107 220/555
5,803,295 A * 9/1998 Tussey ..... B65D 11/10 220/1.5
6,085,932 A * 7/2000 Cope ..... B65D 25/06 220/529
6,170,689 B1 * 1/2001 Flesher ..... B65D 19/06 206/508
6,253,948 B1 * 7/2001 Ficker ..... B65D 21/0223 220/350
6,752,285 B1 6/2004 Scalf
6,874,679 B2 4/2005 Tibbles et al.
7,083,061 B2 * 8/2006 Spindel ..... B65D 11/1826 217/15
7,147,125 B1 * 12/2006 Slovak ..... B65D 81/3818 220/592.2
7,156,249 B2 * 1/2007 Heinrichs ..... B65D 7/28 220/4.28
7,163,122 B2 1/2007 Elder et al.
7,387,350 B2 6/2008 Killinger et al.
7,510,097 B2 * 3/2009 Spindel ..... B65D 11/1826 217/15
7,617,947 B2 * 11/2009 Schafer ..... B65D 21/045 220/558
D719,731 S * 12/2014 Burgess ..... B65D 43/20 D3/302
10,766,692 B2 * 9/2020 Oskarsson ..... B65D 25/24
2004/0134804 A1 7/2004 Yantos
2005/0040064 A1 * 2/2005 Killinger ..... A45C 13/02 206/425
2006/0152114 A1 * 7/2006 Yamada ..... A47B 87/02 312/107
2010/0006467 A1 * 1/2010 Joseph ..... B65D 1/22 206/508
2013/0112701 A1 * 5/2013 Wu ..... B65D 21/0219 220/843
2014/0299489 A1 * 10/2014 Accettola ..... B65D 25/005 206/139
2015/0232238 A1 * 8/2015 Wu ..... B65D 25/38 220/811
2015/0239613 A1 * 8/2015 Hsu ..... B65D 1/22 220/833
2016/0244238 A1 * 8/2016 Hoggan ..... F28D 20/02
2016/0272369 A1 * 9/2016 Hsu ..... B65D 25/005
2017/0267420 A1 * 9/2017 Sudo ..... B65D 25/005
2018/0148216 A1 * 5/2018 Stephens ..... B65B 61/182
2019/0276184 A1 * 9/2019 Kobayashi ..... B65D 43/0202
2020/0270024 A1 * 8/2020 Alberti ..... B65D 43/0214
2020/0399021 A1 * 12/2020 Green ..... B65D 21/0233
2021/0139186 A1 * 5/2021 Kobayashi ..... B65D 21/0233

* cited by examiner 5-5

SELECTIVELY REMOVABLE WALL PORTABLE CONTAINER ASSEMBLY AND METHOD OF USE

FIELD OF THE INVENTION

The present invention relates generally to portable containers, and, more particularly, relates to portable containers with selectively removable lids.

BACKGROUND OF THE INVENTION

As a significant portion of the public utilizes portable storage containers, there is a never-ending need for efficient portable storage containers that are well designed, and which facilitate less burdensome access to stored items. Most portable containers consist of a storage bin which may be selectively removably coupled to a lid thereby creating an interior cavity for storing items. Portable containers come in a variety of sizes and are very well known. Moreover, portable containers are used in a variety of places and are oftentimes capable of being stacked atop one another to form a singular structure made up of a plurality of portable containers in order to maximize space. Sometimes, a user may only access the contents of any portable container by removing the top lid. This presents a problem when, for example, multiple portable containers are stacked atop one another and a user needs to access the contents of a portable container located within the stack. Therefore, removing each portable container within the stack that is on top of the precise container which a user needs to access is very time consuming and burdensome. Thus, a portable container which is stackable yet still provides access to its interior cavity without requiring a user's disassembly of other stacked portable containers is desirable.

Portable containers which employ methods of allowing access to the container's interior contents without removing the container's top lid are known. For example, portable containers which include slidable drawers are known. However, these containers require assembly of a multitude of parts and pieces and are complicated and costlier to assemble. Further, portable containers which include slidable panels are known. However, these devices do not incorporate removable top lids, and therefore these containers only allow access to its interior contents via a singular means. Moreover, these containers do not employ features which prevent moisture or debris from entering the container and damaging the container's contents.

Further, stackable portable containers which include panels that act like doors to the container and have the capability to drop down are known. However, these panels have a tendency to open without intention due to gravitational forces.

Therefore, a need exists to overcome the problems with the prior art as discussed above.

SUMMARY OF THE INVENTION

The invention provides a selectively removable wall portable container assembly that overcomes the hereinaforementioned disadvantages of the heretofore-known devices and methods of this general type and that effectively incorporates a portable container body removably coupled to a detachable lid. The container body defines a container cavity and features a slidable sidewall portion designed to provide access to the container's interior contents located within the container cavity. Further, the assembly is stackable amongst other portable containers. When the assembly is located within a stack of portable containers, a user may gain access to the container cavity by utilizing the slidable sidewall portion.

With the foregoing and other objects in view, there is provided, in accordance with the invention, a selectively removable wall container assembly comprising a portable container body including a bottom wall coupled to a sidewall. The sidewall extends upwardly and away from the bottom wall, enclosing the bottom wall. Together, the bottom wall and the sidewall define a container cavity. The sidewall further includes a left side, a right side opposing the left side, and a longitudinal length separating the left and right sides. The sidewall also includes a front end, a rear end opposing the front end, and an upper end. The front end defines a front opening which is spatially coupled to the container cavity. The sidewall also includes a sidewall height spanning from the bottom wall to the upper end. The sidewall further includes a selectively removable sidewall portion with opposing side ends, and a sidewall portion length separating the opposing side ends. The sidewall portion length substantially spans (e.g., 80% or greater) the longitudinal length. Moreover, the sidewall includes opposing upper and lower ends with a sidewall portion height separating the opposing upper and lower ends. The sidewall portion height substantially spans (e.g., 80% or greater) the sidewall height. Further, the sidewall portion is operably configured to translate along a sidewall translation path. The selectively removable wall container assembly further includes a lid with an upper wall portion that is capable of selectively removably coupling to the upper end of the sidewall in a retained configuration. The selectively removable wall container assembly further includes an encapsulated configuration formed by the bottom wall, sidewall, and lid encapsulating the container cavity. The selectively removable wall container assembly further includes a container cavity access configuration wherein the lid is coupled to the upper end of the sidewall and the sidewall portion of the sidewall is at least partially and slidably removed from the sidewall, exposing the front opening of the sidewall.

In accordance with a further feature, the sidewall translation path is linear.

In accordance with an additional feature of the present invention, the sidewall translation path is disposed in a longitudinal direction.

In some embodiments, the sidewall translation path is disposed in a vertical direction.

In some embodiments, at least one of the sidewall and bottom wall further includes a track sized and shaped to receive a sidewall portion thickness. The sidewall portion thickness is defined by the sidewall portion. The track is operably configured to guide the sidewall portion in an upright orientation in the sidewall translation path.

In accordance with a further feature, the sidewall and/or the lid further include(s) an enclosed opening defined thereon and sized and shaped to receive a sidewall portion thickness defined by the sidewall portion.

In accordance with an additional feature, the sidewall and/or the lid include(s) a polymeric gasket enclosing the enclosed opening.

In additional embodiments, the sidewall portion thickness is substantially uniform across the sidewall portion length and the sidewall portion height.

In some embodiments, the sidewall portion is substantially planar.

In other embodiments, the sidewall portion further includes a keeper member disposed on and projecting outwardly from either a front face and/or a rear face of the sidewall portion. The keeper member is disposed proximal to one of the opposing side ends of the sidewall portion that is farthest away from the enclosed opening when in the encapsulated configuration. The keeper member includes a surface operably configured to impede translation of the sidewall portion along the sidewall translation path.

In accordance with yet another feature, an embodiment of the present invention includes a secondary portable container having a secondary portable container body and a secondary lid. The secondary lid is selectively removably coupled to an upper end of a sidewall of the secondary portable container body in a retained configuration. The secondary portable container is operably configured to seat on the lid of the selectively removable wall portable container assembly in a retained stacked assembly configuration.

In accordance with the present invention, a method for providing selective access to a portable container and stackable container assembly includes various steps. The process begins with the step of providing a portable container body with a lid. The container body includes a bottom wall coupled to a sidewall that extends upwardly and away from the bottom wall and encloses the bottom wall. The bottom wall and sidewall define a container cavity. Moreover, the sidewall includes a front end that defines a front opening that is spatially coupled to the container cavity. The sidewall includes a selectively removable sidewall portion that superimposes the front opening. Further, the sidewall and/or the lid define an enclosed opening thereon sized and shaped to receive a sidewall portion thickness that is defined by the sidewall portion. The process continues with the step of coupling the lid with an upper end of the sidewall in a retained configuration to encapsulate the container cavity. Next, the process continues with the step of translating the sidewall portion along a sidewall translation path to expose the front opening of the sidewall.

In accordance with another feature, the sidewall of the container body includes a left side, a right side opposing the left side, and a longitudinal length separating the left and right sides of the sidewall. The sidewall further includes a rear end separating the front end of the sidewall, an upper end, and a sidewall height spanning from the bottom wall to the upper end of the sidewall. The sidewall portion includes a sidewall portion length that separates opposing side ends thereon and substantially spans (e.g., 80% or greater) the longitudinal length. The sidewall further includes a sidewall portion height that separates opposing upper and lower ends thereon and substantially spans (e.g., 80% or greater) the sidewall height.

In accordance with another feature, the front opening substantially spans (e.g., 80% or greater) the longitudinal length of the sidewall. The method of providing selective access to a portable container and stackable container assembly may further include the step of translating the sidewall portion along a sidewall translation path to expose the entire front opening of the sidewall.

In accordance with another feature, the method of providing selective access to a portable container and stackable container assembly, the process may include various other steps. The process may include with the step of providing a secondary portable container body. Next, the process continues with the step of coupling a secondary lid onto the secondary container body in the retained configuration. Finally, the process may include the step of coupling the secondary portable container body in the retained configuration to the lid of the portable body in a seated configuration.

One objective of the present invention is to provide durable storage devices, which are lightweight and portable.

Another objective of the present invention is to provide storage devices which are resistant to moisture.

Another objective of the present invention is to provide storage devices which prevent debris from entering the container cavity.

Another objective is to provide portable containers which are stackable atop one another.

Another objective is to enable a user to open a slidable portion of the portable container's sidewall and access the interior of the container without having to remove the top lid.

Yet another objective is to enable a user to access the interior of a stacked container though a slidable portion of the sidewall without having to remove the portable containers stacked on top of it.

Although the invention is illustrated and described herein as embodied in a selectively removable wall portable container assembly and method of use, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the selectively removable sidewall portion of the assembly. Further, in this document, the term "vertical" should be understood to mean in a direction directly opposite of the longitudinal direction.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
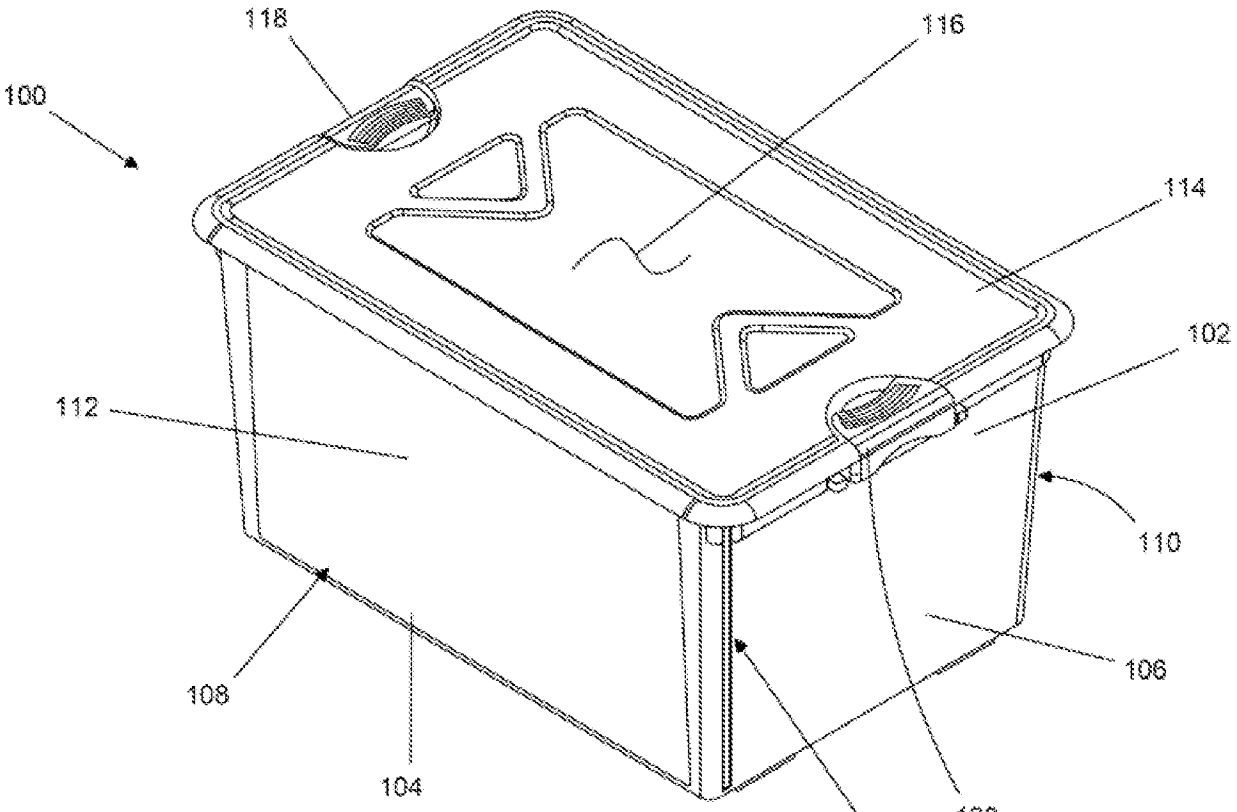
FIG. 1 is a perspective view of a selectively removable wall portable container assembly according to one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

The present invention provides a novel and efficient selectively removable wall portable container assembly. Embodiments of the invention provide a container body selectively removably coupled to a lid. The container body includes a bottom wall and a sidewall that extends upwardly from and encloses the bottom wall, creating a container cavity. In addition, the sidewall includes a front opening that is spatially coupled to the container cavity and a selectively removable sidewall portion that superimposes the front opening. The sidewall portion provides access to the container cavity by translating along a sidewall translation path. Embodiments of the invention enable the user to access the container's contents without necessarily having to remove the lid.

Figure 2:
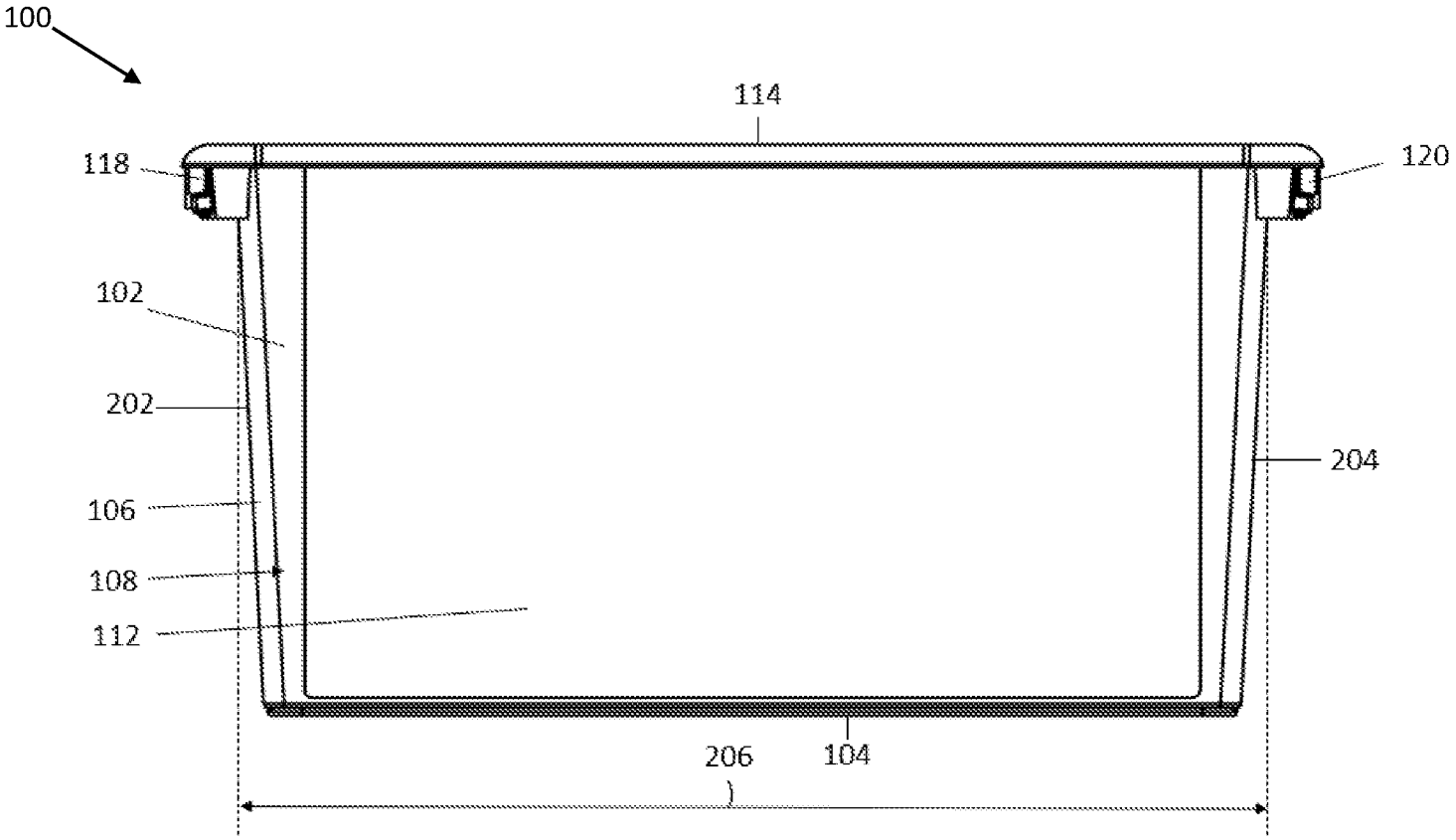
FIG. 2 is a front view of a selectively removable wall portable container assembly in accordance with one embodiment of the present invention.
Figure 5:
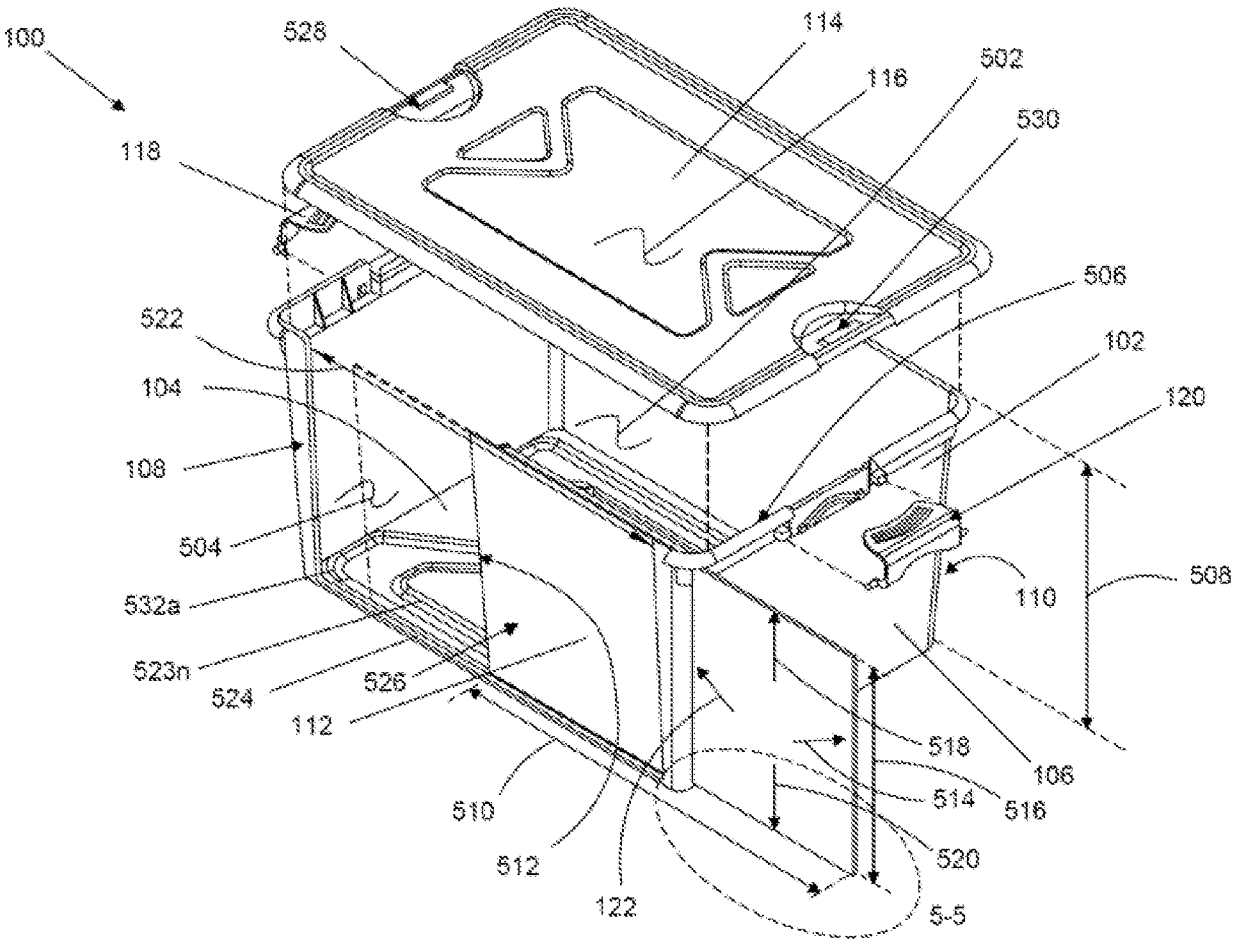
FIG. 5 is an exploded view of a selectively removable wall portable container assembly in accordance with one embodiment of the present invention.

Referring now to FIGS. 1-2 and 5, one embodiment of the present invention is shown in a perspective and front view, respectively. FIG. 1, along with other figures, show several advantageous features of the present invention, but, as will be described below, the invention can be provided in several shapes, sizes, combinations of features and components, and varying numbers and functions of the components. The first example of a selectively removable wall portable container assembly 100, as shown best in FIGS. 1-2, includes a portable container body 102 with a bottom wall 104 and a sidewall 106 coupled to the bottom wall 104. The sidewall 106 extends upwardly and away from the bottom wall 104. Moreover, the sidewall 106 encloses the bottom wall 104, defining a container cavity 502. The sidewall 106 includes a left side 202 and a right side 204 opposing the left side 202. There is a longitudinal length 206 separating the left and right sides 202, 204 of the sidewall 106. The sidewall 106 further includes a front end 108 defining a front opening 504 (best depicted in FIG. 5) spatially coupled to the container cavity 502 and a rear end 110. The rear end 110 separates the front end 108 of the sidewall 106 from one another. The sidewall 106 further includes an upper end 506 and a sidewall height 508 which spans from the bottom wall 104 to the upper end 506 of the sidewall 106. The sidewall 106 further includes a selectively removable sidewall portion 112 with a sidewall portion length 510 separating opposing ends 512, 514 thereon and substantially spanning (e.g., 80% or greater) the longitudinal length 206 of the sidewall 106.

Moreover, the selectively removable sidewall portion 112 includes a sidewall portion height 516 separating opposing upper and lower ends 518, 520 thereon which substantially span (e.g., 80% or greater) the sidewall height 508.

The selectively removable sidewall portion 112 is operably configured to translate along a sidewall translation path (represented in an exemplary path with lines 522). The selectively removable wall portable container assembly 100 further includes a lid 114 with an upper wall portion 116 which is capable of selectively removably coupling to the upper end 506 of the sidewall 106. The assembly 100 is capable of achieving a retained configuration and an unretained configuration with respect to the portable container body 102 and the lid 114. When the upper wall portion 116 of the lid 114 is coupled to the upper end 506 of the sidewall 106, the assembly 100 is in the retained configuration. When the upper wall portion 116, or a portion of the upper wall portion 116, of the lid 114 is uncoupled to the upper end 506 of the sidewall 106, the assembly 100 is in the unretained configuration. Further, the assembly 100 is also capable of being disposed in an encapsulated configuration with respect to the bottom wall 104, sidewall 106, and lid 114 in which the container cavity 502 is fully encapsulated or enclosed within the bottom wall 104, sidewall 106, and lid 114. Finally, the assembly 100 includes a container cavity access configuration wherein the lid 114 is coupled to the upper end 506 of the sidewall 106 and the sidewall portion 112 of the sidewall 106 is at least partially and slidably removed from the sidewall 106, exposing the front opening 504 of the sidewall 106.

In a further embodiment, the sidewall 106 of the portable container body 102 further includes two latch members 118, 120 coupled thereto. The latch members 118, 120 are disposed on the left and right sides 202, 204 of the sidewall 106.

In a further embodiment, the upper wall portion 116 of the lid 114 includes latch member receiving areas 528, 530. The latch member receiving areas 528, 530 are sized and shaped to receive the latch members 118, 120. The latch members 118, 120 are operably configured to selectively removably couple to the latch member receiving areas 528, 530 and securely lock the lid 114 in place on the upper end 506 of the portable container body 102.

In most embodiments, the selectively removable wall portable container assembly 100 will be of lightweight materials (e.g., plastic, PVC, acrylic, rubber, or any other material that is lightweight, sturdy, and durable), thereby making the assembly 100 easily transportable or portable.

In most embodiments, the container cavity 502 is shaped and sized to be capable of holding approximately 16-20 gallons. In other embodiments, the container cavity 502 may be larger or smaller.

In a further embodiment, the sidewall translation path (represented in an exemplary path with lines 522) of the selectively removable wall portable container assembly 100 is linear. The sidewall translation path 522 of the selectively removable wall portable container assembly 100 is disposed in a longitudinal direction. Said another way, the sidewall portion 112 is selectively removable from the container body 102 by sliding the sidewall portion 112 longitudinally left or right from the container body 102. In one embodiment, when the lid 114 is coupled to the body 102, the sidewall portion 112 is only translatable in the longitudinal direction. Said another way, the user is able to beneficially access the container cavity 502 when the lid 114 is coupled to the body in a sealed configuration and/or when a secondary container body 902 (shown best in FIG. 9) is stacked on top of the container body 102 and lid 114. In some embodiments, the sidewall portion 112 is only capable of translation in the vertical direction when the lid 114 is removed from the container body 102.

Figure 11:
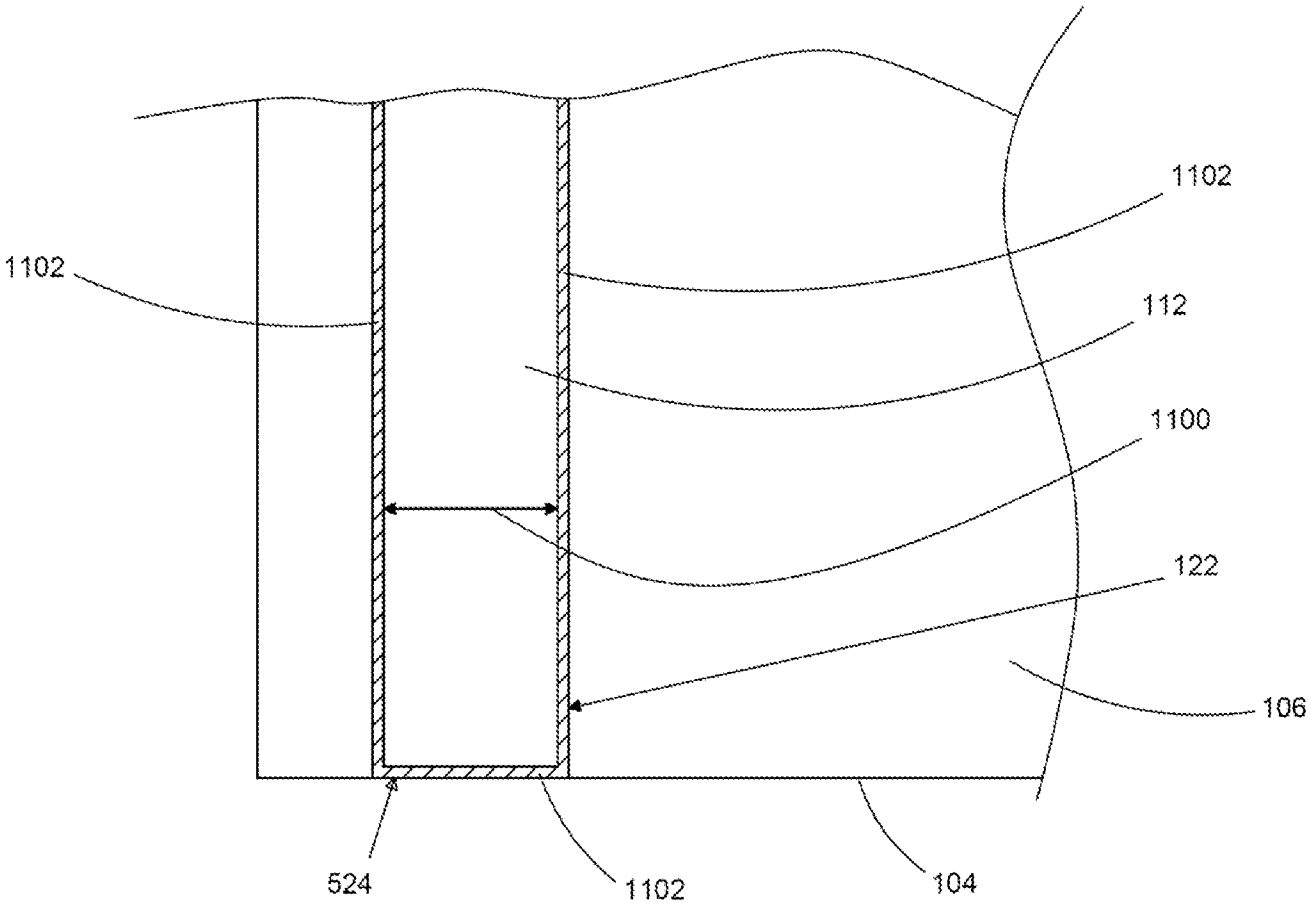
FIG. 11 depicts a close-up view of section 5-5 in FIG. 5 a perspective view of a portable container and stackable container assembly with the selectively removable wall partially removed therefrom in accordance with another embodiment of the present invention.

With reference to FIG. 1 FIG. 5 and FIG. 11 (which depicts a close-up section 5-5 in FIG. 5) , in some embodiments, at least one of the sidewall 106 and bottom wall 104 further comprises a track 524 sized and shaped to receive a sidewall portion thickness 1100 defined by the sidewall portion 112 and operably configured to guide the sidewall portion 112 in an upright orientation in the sidewall translation path 522.

In a further embodiment, as seen in FIG. 1 and FIG. 11, the sidewall 106 further comprises an enclosed opening 122 defined thereon and sized and shaped to receive a sidewall portion thickness (not shown) defined by the sidewall portion 112. The enclosed opening 122 is operably configured to achieve the container cavity access configuration discussed above.

In a further embodiment as seen in FIG. 1, FIG. 5, and FIG. 11, the sidewall 106 includes a polymeric gasket 1102 enclosing the enclosed opening. The polymeric gasket 1102 is designed to prevent moisture and/or debris from entering into the container cavity 502 when the assembly 100 is in the encapsulated configuration.

In some embodiments, as seen in FIG. 1, FIG. 5, and FIG. 11, the sidewall portion thickness 1100 is substantially uniform across the sidewall portion length 510 and the sidewall portion height 516.

In some embodiments, the sidewall portion 112 is fsubstantially planar, or flat.

In some embodiments, the sidewall portion 112 further includes a front face 526 and a rear face (not shown) opposing the front face 526. Further, the sidewall portion 112 includes a keeper member (not shown) disposed on and projecting outwardly from either the front face 526 and/or the rear face. The keeper member is disposed proximal to one of the opposing side ends 512, 514 of the sidewall portion 112. When the assembly 100 is in the encapsulated configuration, the keeper member is disposed proximal to one of the opposing side ends 512, 514 farthest from the enclosed opening. The keeper member includes a surface (not shown) operably configured to impede translation of the sidewall portion 112 along the sidewall translation path 522. The surface of the keeper member may be of rubber, polyethylene, ethylene propylene diene, silicone or any other material capable of creating frictional force and biasing the sidewall portion 112 in the encapsulated configuration.

In a further embodiment, in order to allow full range of access to the interior contents of the container cavity 502 and remove the sidewall portion 112 completely from the portable container body 102, a user merely has to complete the following steps: remove the lid 114 from the portable container body 102 and pull the sidewall portion 112 in an upwards direction away from the bottom wall 104 of the container body 102.

In a further embodiment, the lid 114 includes a lower wall portion (not shown) opposing the upper wall portion 116. The lower wall portion may include at least two protruding tab members (not shown), a slot (not shown), and a track (not shown) sized and shaped to receive a sidewall portion thickness 1100 defined by the sidewall portion 112. Together, the protruding tab members, the slot, and the track are operably configured to store the sidewall portion 112 in close proximity (e.g., within approximately 0-1 inch) to the lower wall portion of the lid 114 within the container cavity 502.

In some embodiments, the lid 114 may include an enclosed opening (not shown) similar to the enclosed opening of the sidewall 106, defined thereon and sized and shaped to receive a sidewall portion thickness (not shown) defined by the sidewall portion 112. When removing and replacing the lid 114 onto the upper end 506 of the container body 102, a user would align the lid 114 on the upper end 506 of the container body 102 wherein the enclosed opening of the lid 114 is disposed proximal to the front end 108 of the sidewall 106 of the container body 102. The enclosed opening allows a user to at least partially remove the sidewall portion 112 from the container body 102 and expose the front opening 504 to the container cavity 502 without necessarily having to remove the lid 114, achieving the container cavity access configuration discussed above.

In a further embodiment, the lid 114 includes a polymeric gasket (not shown) enclosing the enclosed opening. The polymeric gasket is designed to prevent moisture and/or debris from entering the container cavity 502 when the assembly 100 is in the encapsulated configuration.

It should be understood that terms such as, "front," "rear," "side," top," "bottom," and the like are indicated from the reference point of a viewer viewing the selectively removable wall portable container assembly 100 from its front end 108 (see FIG. 2).

As used herein, the term "wall" is intended broadly to encompass continuous structures, as well as, separate structures that are coupled together to form a substantially continuous external surface.

Figure 8:
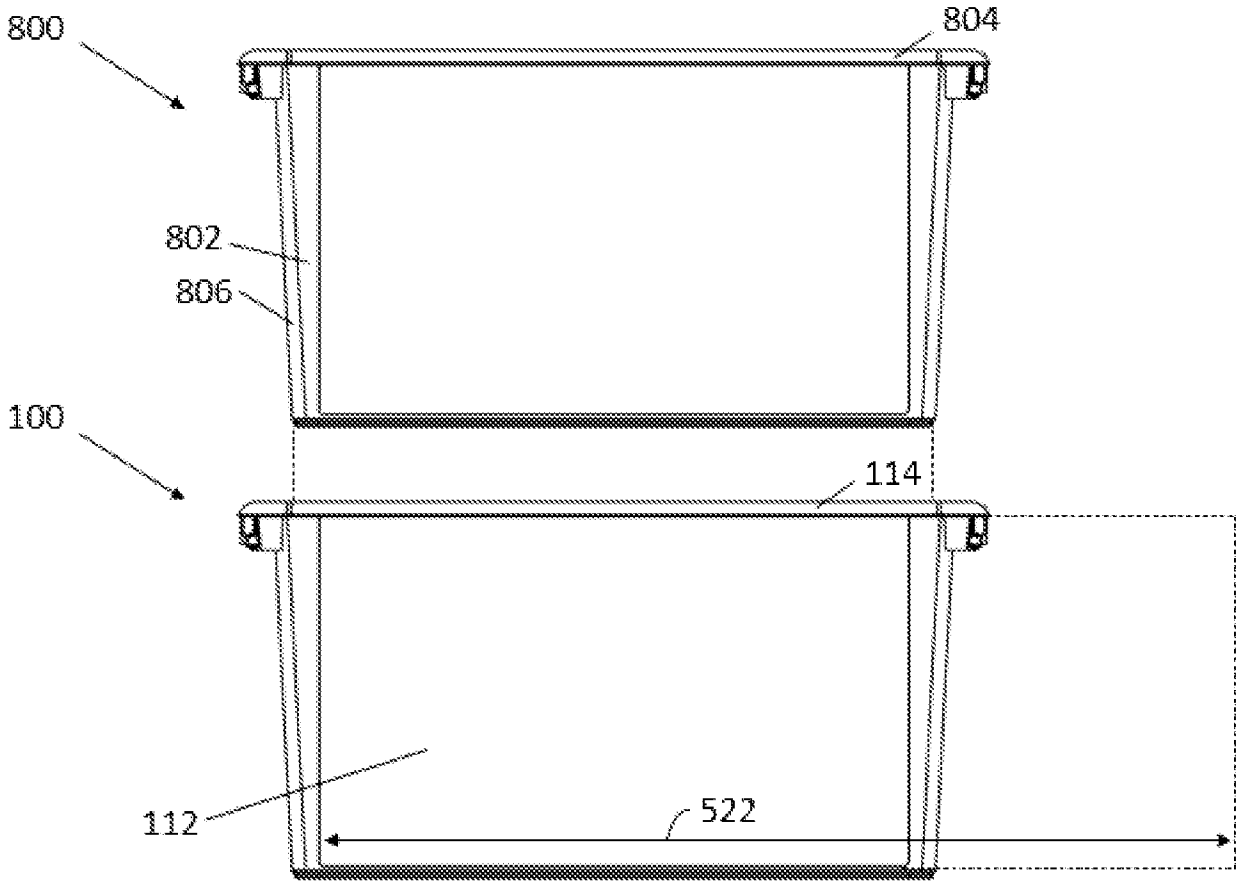
FIG. 8 is a front view of a portable container and stackable container assembly in accordance with one embodiment of the present invention.

Referring now to FIG. 8, in some embodiments, the assembly 100 further comprises a secondary portable container 800 including all of the same main components that the assembly 100 includes as described above. The secondary portable container 800 similarly includes a secondary portable container body 802 and a secondary lid 804. The secondary lid 804 is selectively removably coupled to an upper end (not shown) of a sidewall 806 of the secondary portable container body 802 in a retained configuration. Further, the portable container body 802 of the secondary portable container 800 is operably configured to seat on the lid 114 of the selectively removable wall portable container assembly 100 in a retained stacked assembly configuration. Said another way, the secondary portable container 800 has the capability of stacking on top of the lid 114 of the assembly 100 forming a singular structure.

Figure 3:
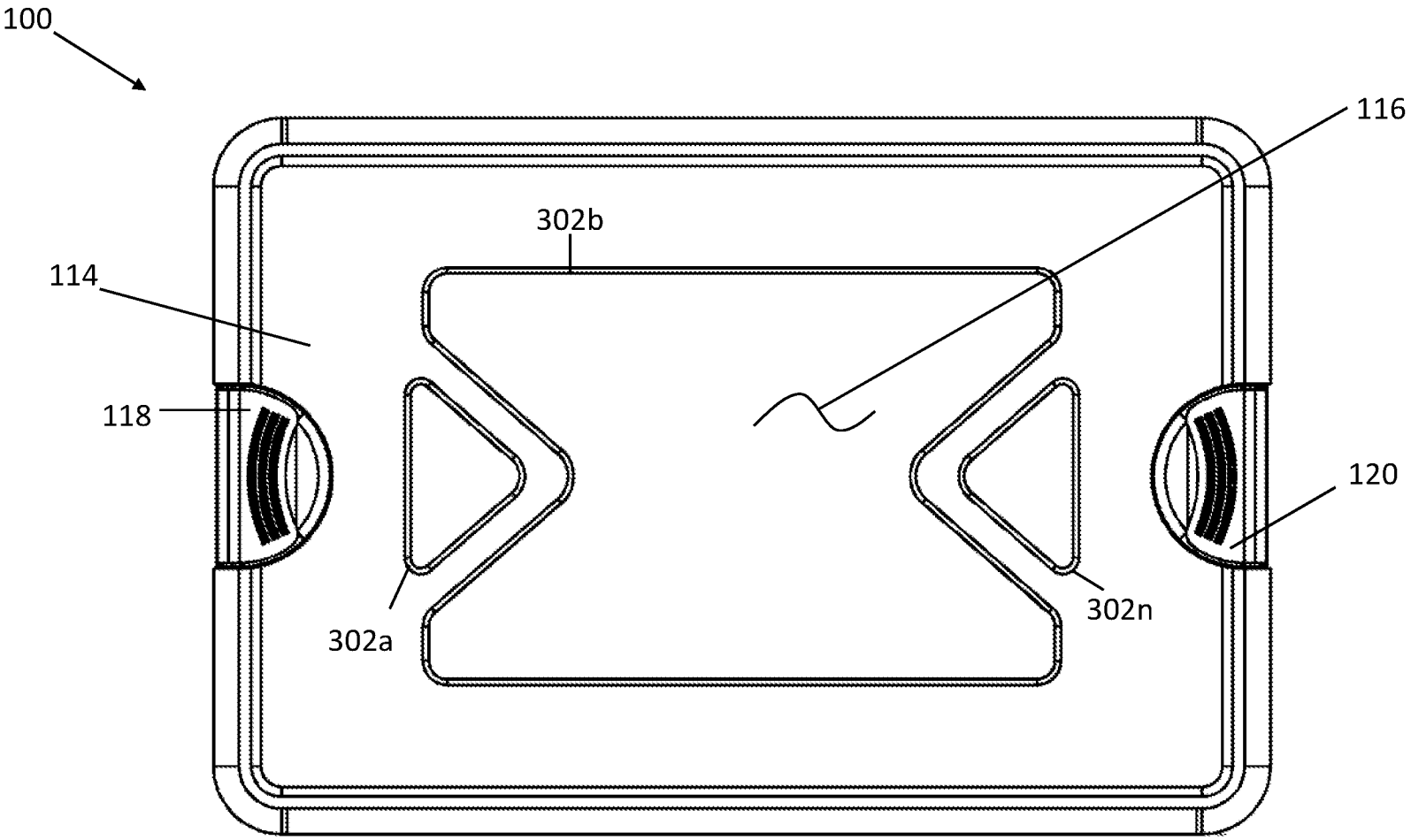
FIG. 3 is a top plan view of a selectively removable wall portable container assembly according to one embodiment of the present invention.
Figure 4:
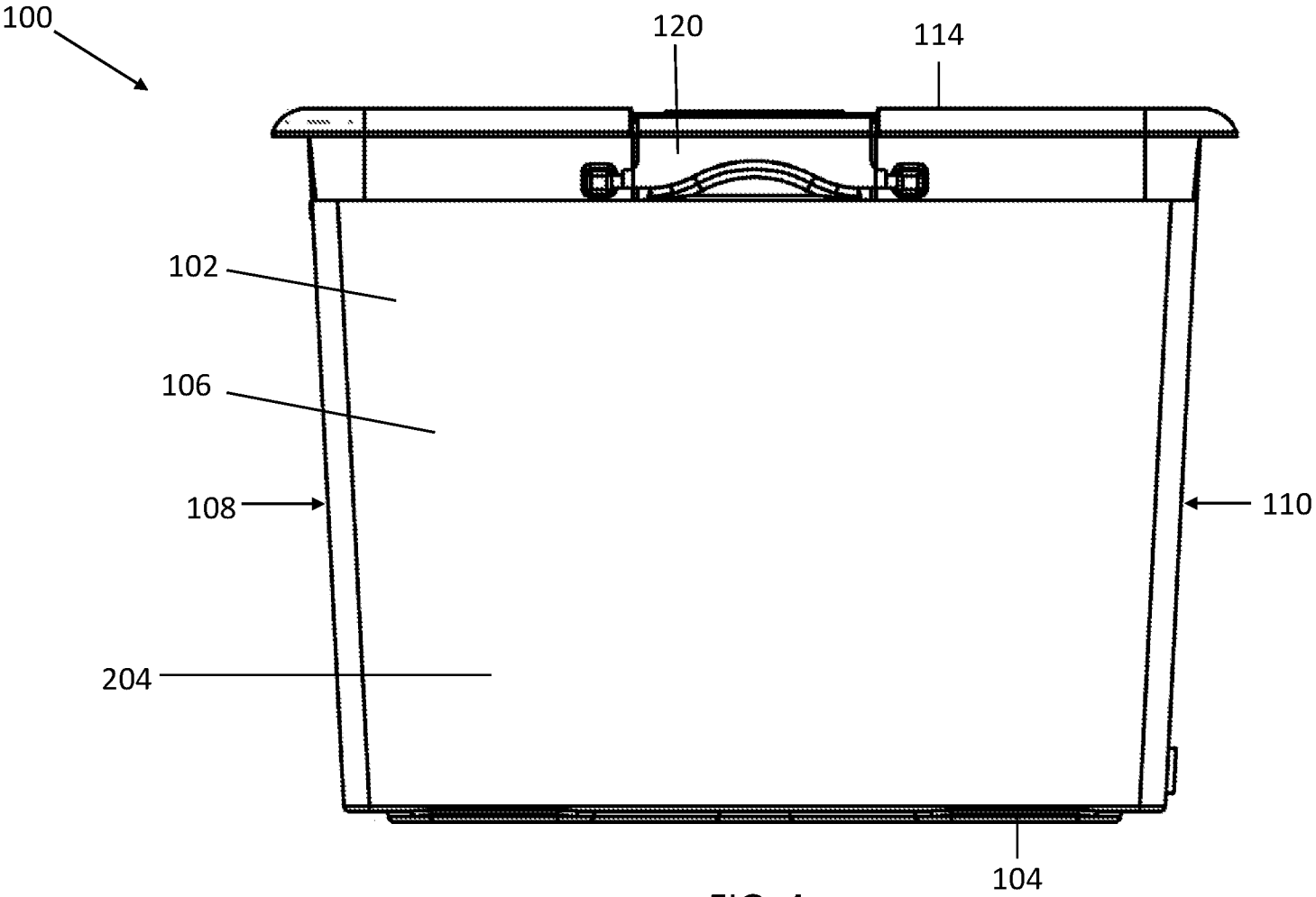
FIG. 4 is a side view of a selectively removable wall portable container assembly in accordance with one embodiment of the present invention.

In some embodiments, as depicted in FIG. 3, the lid 114 may include a plurality of ridges 302*a-n,* where "n" represents any number greater than one. Further, as shown in FIG. 5, the bottom wall 104 of the portable container body 102 includes a plurality of ridges 532*a-n,* where "n" represents any number greater than one. The plurality of ridges 532*a-n* are sized and shaped to be of a complementary coupling configuration with the plurality of ridges 302*a-n* of the lid 114. The coupling of the plurality of ridges 302*a-n* with the plurality of ridges 532*a-n* is designed to resist lateral movement and create a secure singular structure. The secondary portable container 800 includes all of the same features as described herein, therefore, when, for example, the container body 802 of the secondary portable container 800 is stacked on top of the lid 114 of the assembly 100, the structure is secure in the retained stacked assembly configuration. For exemplary purposes, when, for example, the secondary portable container 800 is stacked atop assembly 100, the container cavity 502 (not shown) is still accessible through the slidable panel 112 and the container cavity access configuration discussed above is still achievable. Said another way, access to the container cavity 502 is not hindered solely because the secondary portable container 800 is stacked atop the lid 114 of the assembly 100 because the sidewall translation path 522 is disposed in a longitudinal direction. Notably, this embodiment also allows the interior cavity (not shown) of the secondary portable container 800 to be accessed simultaneously as when a user accesses the container cavity 502 of the assembly 100 in the retained stacked assembly configuration.

Figure 10:
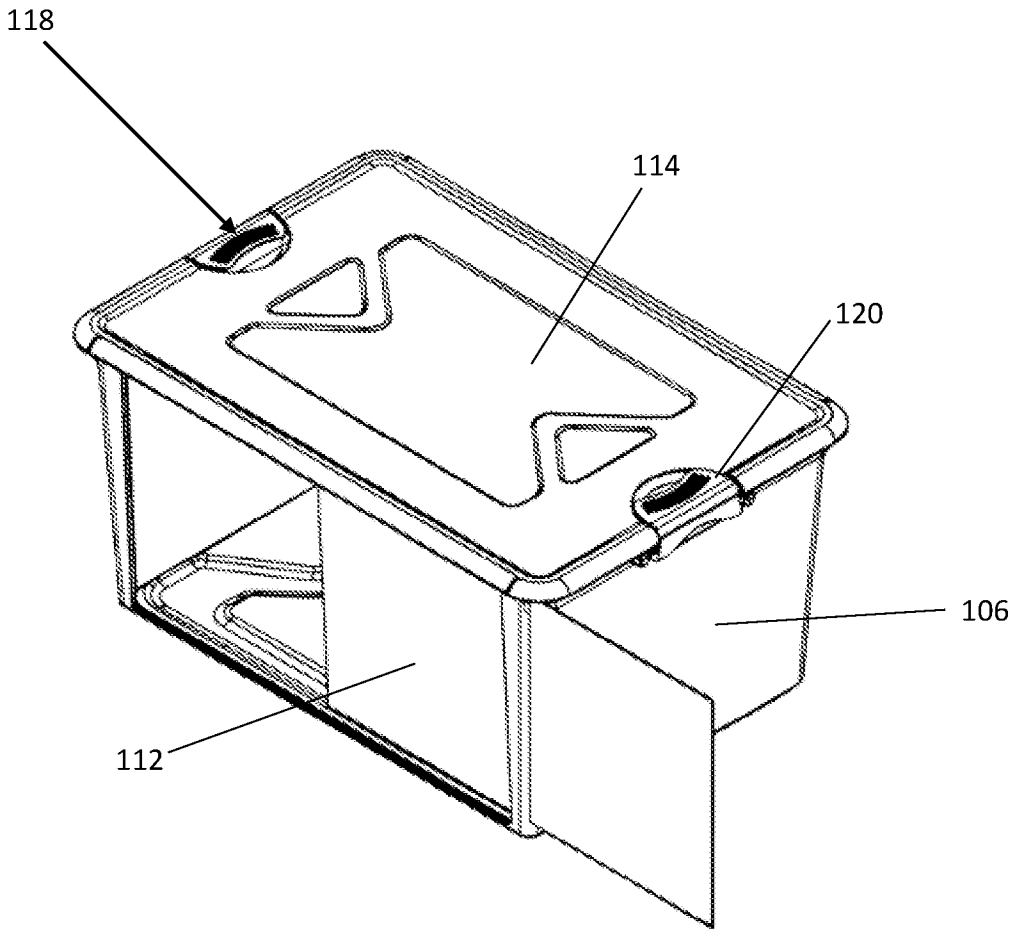
FIG. 10 is a perspective view of a portable container and stackable container assembly with the selectively removable wall partially removed therefrom in accordance with another embodiment of the present invention.

With brief reference to FIG. 10, the assembly 100 is shown with the sidewall 112 translated in the longitudinal direction and partially exposing the container cavity 502. However, the cover or lid 114 is coupled to the body of the assembly 100, thereby demonstrating the ability to slide the removably sidewall portion 112 in the longitudinal direction or translation path. This is extremely beneficial when stacking multiple containers on top of another, as a user may access contents within a container on a bottom of the stack without having to remove the other containers on top of it. As such, the slot in which the removable portion 112 translates through is disposed and oriented in a manner below an upper edge of the body of the container 100 so as to not affect the integrity of the coupling configuration between the lid 114 and the container body.

Figure 6:
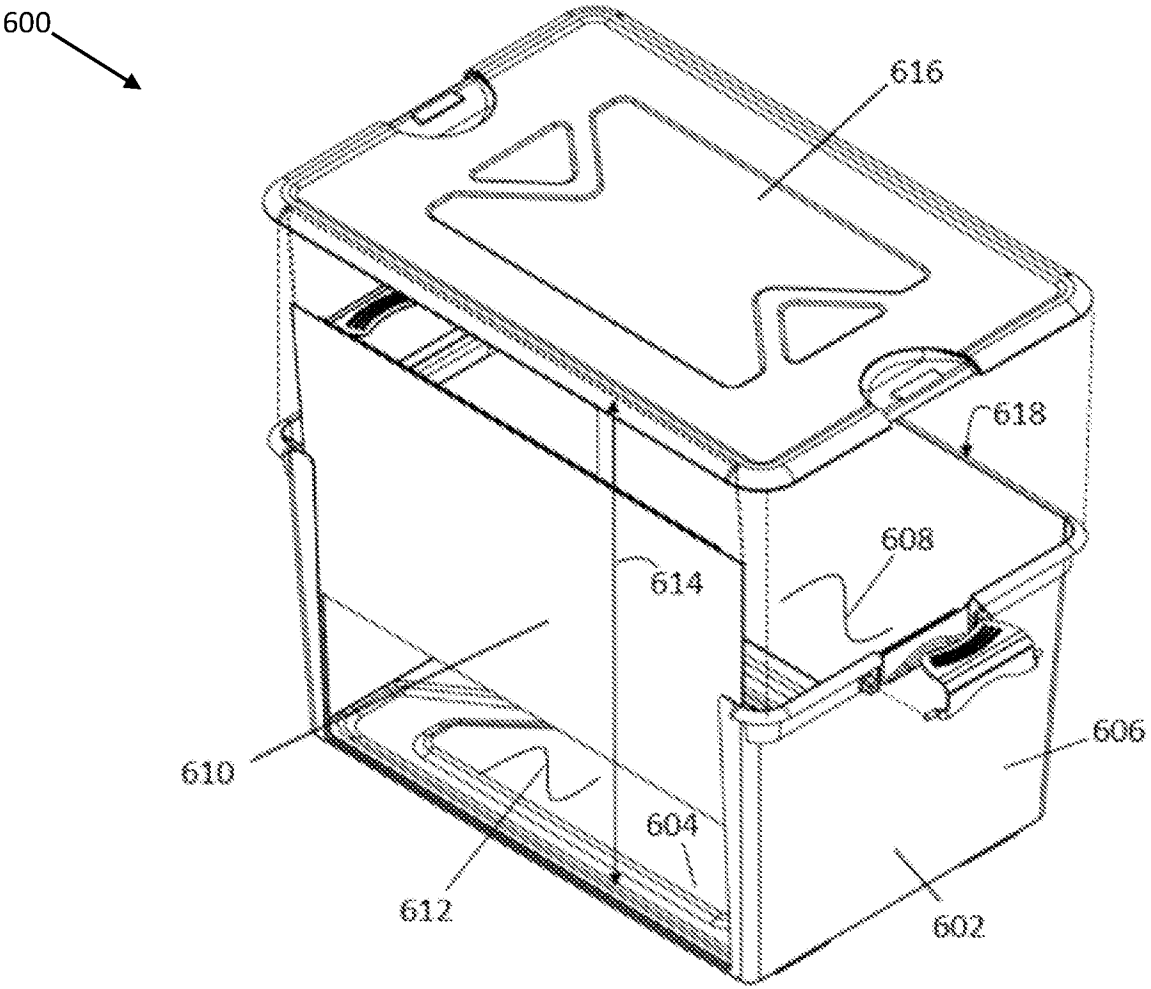
FIG. 6 is an exploded view of a selectively removable wall portable container assembly in accordance with another embodiment of the present invention.

Another embodiment of the present invention is depicted in FIG. 6. This embodiment of a selectively removable wall portable container assembly 600 comprises many of the same features as the selectively removable wall portable container assembly 100 discussed above and therefore for the sake of brevity, only the differences will be discussed herein. The assembly 600 instead includes a portable container body 602 having many of the same features as the portable container body 102 of the assembly 100. The portable container body 602 similarly includes a bottom wall 604, a sidewall 606 enclosing the bottom wall 604 and creating a container cavity 608. The sidewall 606 includes a selectively removable sidewall portion 610 defining a front opening 612. The selectively removable sidewall portion 610 is operably configured to translate along a sidewall translation path (represented in an exemplary path with lines 614). The selectively removable wall portable container assembly 600 further includes a lid 616. Further, the assembly 600 is also capable of being disposed in an encapsulated configuration with respect to the bottom wall 604, sidewall 606, and lid 616 in which the container cavity 608 is fully encapsulated or enclosed within the bottom wall 604, sidewall 606, and lid 616. The assembly 600 similarly includes a container cavity access configuration wherein the lid 616 is coupled to an upper end 618 of the sidewall 606 and the sidewall portion 610 of the sidewall 606 is at least partially and slidably removed from the sidewall 602, exposing the front opening 612 of the sidewall 606. In this embodiment, however, the sidewall 606 of the assembly 600 does not include the enclosed opening defined on the sidewall 106 of the assembly 100 described above.

In a further embodiment, the sidewall translation path (represented in an exemplary path with lines 614) of the selectively removable wall portable container assembly 600 is linear. The sidewall translation path 614 of the selectively removable wall portable container assembly 600 is disposed in a vertical direction. Said another way, the sidewall portion 610 is selectively removable from the container body 602 by sliding the sidewall portion 610 vertically up or down from the container body 602 and achieving the container cavity access configuration discussed above.

In a further embodiment, the lid 616 further comprises an enclosed opening (not shown) defined thereon and sized and shaped to receive a sidewall portion thickness 1100 shown in FIG. 11) defined by the sidewall portion 610. When removing and replacing the lid 616 onto the upper end 618 of the container body 602, a user would align the lid 616 on the upper end 618 of the container body 602 wherein the enclosed opening of the lid 616 is disposed proximal to the front end (not shown) of the sidewall 606 of the container body 602. The enclosed opening allows a user to at least partially remove the sidewall portion 610 from the container body 602 and expose the front opening 612 to the container cavity 608 without necessarily having to remove the lid 616, achieving the container cavity access configuration discussed above.

In a further embodiment, the lid 616 includes a polymeric gasket (not shown) enclosing the enclosed opening. The polymeric gasket is designed to prevent moisture and/or debris from entering the container cavity 608 when the assembly 600 is in the encapsulated configuration.

Figure 9:
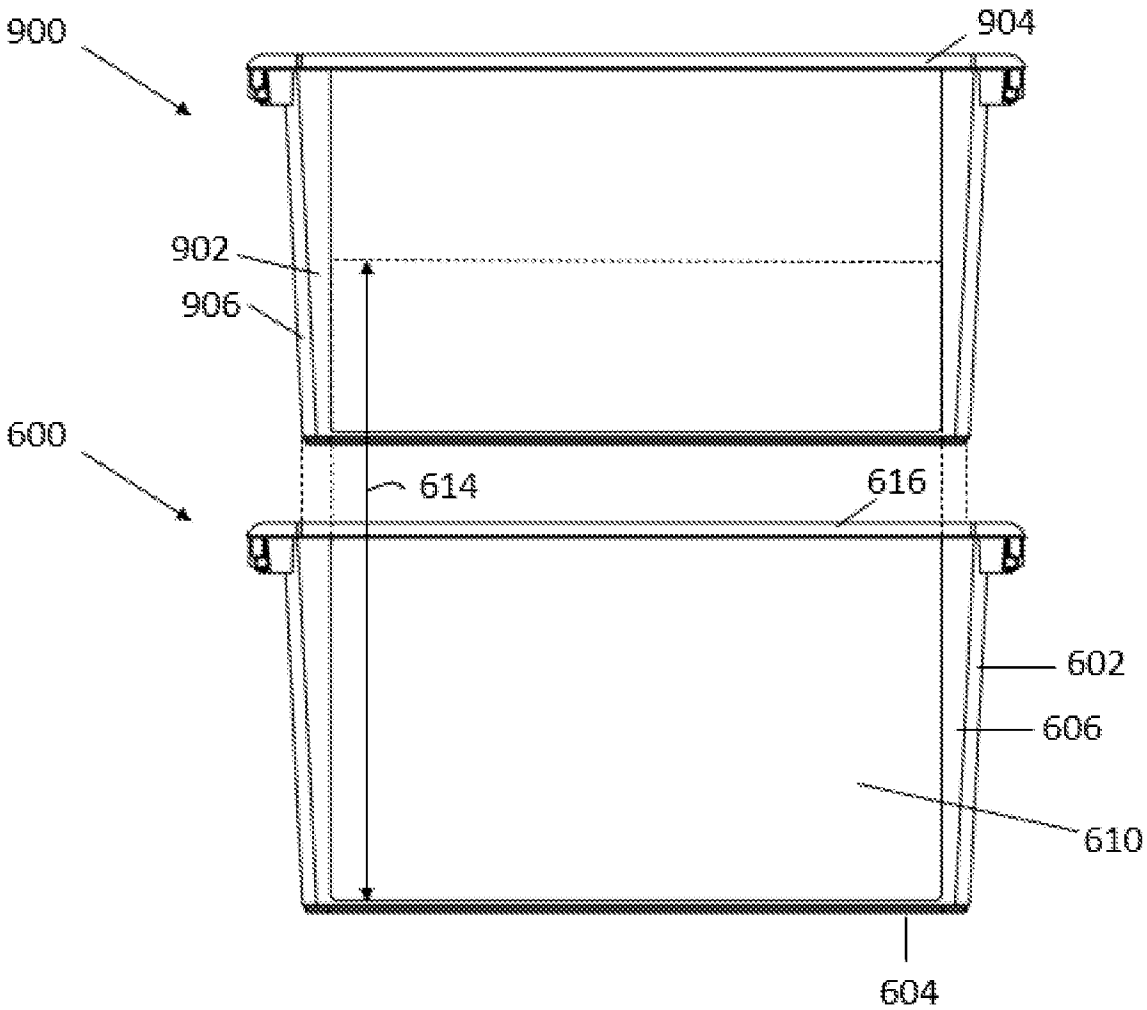
FIG. 9 is a front view of a portable container and stackable container assembly in accordance with another embodiment of the present invention.

Referring now to FIG. 9, in some embodiments, the assembly 600 further comprises a secondary portable container 900 including the same features as the assembly 600. The secondary portable container 900 similarly includes a secondary portable container body 902 and a secondary lid 904. The secondary lid 904 is selectively removably coupled to an upper end (not shown) of a sidewall 906 of the secondary portable container body 902 in a retained configuration. Further, the secondary portable container 900 is operably configured to seat on the lid 616 of the selectively removable wall portable container assembly 600 in a retained stacked assembly configuration. Said another way, the secondary portable container 900 has the capability of stacking on top of the lid 616 of the assembly 600 forming a singular structure. For exemplary purposes, when, for example, the secondary portable container 900 is stacked atop assembly 600, the container cavity 608 (not shown) is still accessible through the sidewall portion 610 and the container cavity access configuration discussed above is still achievable. Said another way, access to the container cavity 608 is not hindered solely because the secondary portable container 900 is stacked atop the lid 616 of the assembly 600. To clarify, the sidewall translation path 614 is disposed in a vertical direction and the sidewall 606 of the container body 602 extends upwardly and away from the bottom wall 604. The secondary portable container 900 features the same components as the assembly 600, therefore, when in the retained stacked assembly configuration, space for the sidewall translation path 614 of the sidewall portion 610 is allotted to achieve the container cavity access configuration.

Figure 7:
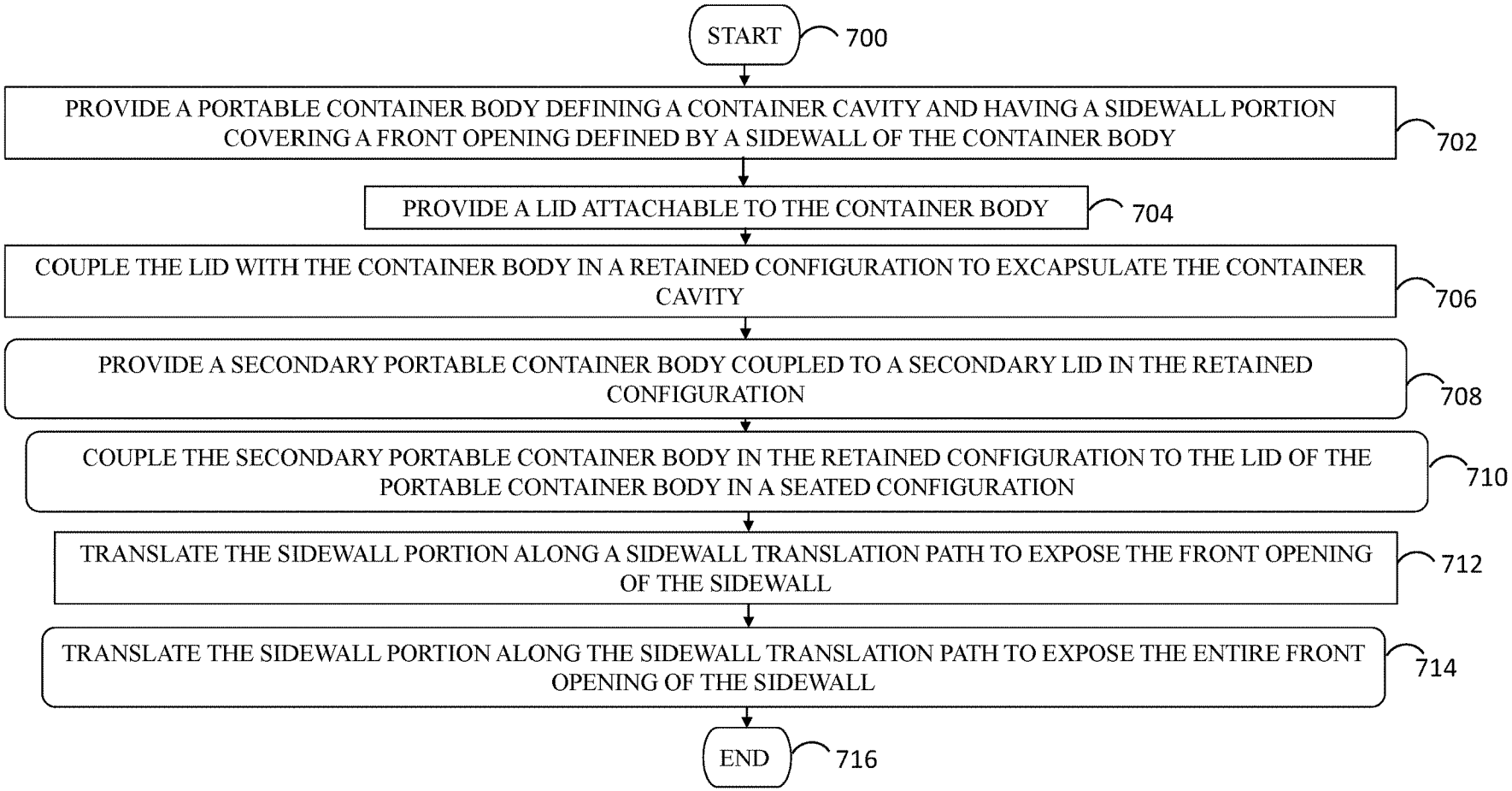
FIG. 7 is a process flow diagram depicting a method of providing selective access to a portable container and stackable container assembly in accordance with the present invention.

With reference now to FIG. 7, a process flow diagram depicting one exemplary method of providing selective access to a portable container and stackable container assembly is shown. The process starts at step 700 and immediately proceeds to step 702 of providing a portable container body. The container body defines a container cavity and includes a sidewall portion covering a front opening defined by a sidewall of the container body. The process continues to step 704 of providing a lid attachable to the container body. Next, the process continues to step 706 of coupling the lid with the container body in a retained configuration to encapsulate the container cavity. Subsequently, the process continues to step 708 of providing a secondary portable container body coupled to a secondary lid in the retained configuration. The process continues to step 710 of coupling the secondary portable container body in the retained configuration to the lid of the portable container body in the retained configuration. Next, step 712 includes translating the sidewall portion along a sidewall translation path to expose the front opening of the sidewall. Lastly, should a user decide to remove the entire sidewall portion, step 714 includes translating the sidewall portion along the sidewall translation path to expose the entire front opening of the sidewall. The process then terminates at step 716. While the above described steps are preferably carried out in the above order, variations of the order of said steps can be deviated as will be appreciated by those of skill in the art.

As such, a selectively removable wall portable container assembly has been disclosed that includes a portable container body with a bottom wall coupled to and enclosed by a sidewall that define a container cavity. The sidewall defines a front opening spatially coupled to the container cavity. The front opening is superimposed by a selectively removable sidewall portion that is configured to translate along a sidewall translation path. Further, the assembly also includes a lid that is removably coupled to the container body in a retained configuration. Together, the portable container body and the lid in the retained configuration are capable of achieving an encapsulated configuration and a container access configuration. Moreover, the assembly is capable of securely coupling to another selectively removable wall container assembly in a stacked configuration and still achieving both the encapsulated configuration and the container access configuration.

What is claimed is:

1. A selectively removable wall portable container assembly comprising:

a portable container body with a bottom wall and a sidewall coupled to, extending upwardly away from, and enclosing the bottom wall, the bottom wall and sidewall defining a container cavity and the sidewall having:

a left side, a right side opposing the left side, a longitudinal length separating the left and right sides of the sidewall, a front end defining a front opening spatially coupled to the container cavity, a rear end opposite the front end of the sidewall, an upper end, and a sidewall height spanning from the bottom wall to the upper end of the sidewall;

a selectively removable sidewall portion with a sidewall portion length separating opposing side ends thereon and substantially spanning the longitudinal length and a sidewall portion height separating opposing upper and lower ends thereon and substantially spanning the sidewall height, the sidewall portion operably configured to translate along a sidewall translation path; and an enclosed opening defined thereon and sized and shaped to receive a sidewall portion thickness defined by the selectively removable sidewall portion, a lid with an upper wall portion selectively removably coupled to the upper end of the sidewall in a retained configuration;

an encapsulated configuration with the bottom wall, sidewall, and lid encapsulating the container cavity and with the lid entirely covering the upper end of the selectively removable sidewall portion along the entire sidewall portion length; and a container cavity access configuration with the lid coupled to the upper end of the sidewall and the sidewall portion of the sidewall at least partially and slidably removed from the sidewall, exposing the front opening of the sidewall.

2. The selectively removable wall portable container assembly according to claim 1, wherein:

the sidewall translation path is linear.

3. The selectively removable wall portable container assembly according to claim 2, wherein:

the sidewall translation path is disposed in a longitudinal direction.

4. The selectively removable wall portable container assembly according to claim 1, wherein at least one of the sidewall and bottom wall further comprises:

a track sized and shaped to receive a sidewall portion thickness defined by the sidewall portion and operably configured to guide the sidewall portion in an upright orientation in the sidewall translation path.

5. The selectively removable wall portable container assembly according to claim 4, wherein:

the sidewall portion thickness is substantially uniform across the sidewall portion length and the sidewall portion height.

6. The selectively removable wall portable container assembly according to claim 4, wherein: the sidewall portion is planar.

7. The selectively removable wall portable container assembly according to claim 1, further comprising:

a secondary portable container with a secondary portable container body and a secondary lid selectively removably coupled to an upper end of a sidewall of the secondary portable container body in a retained configuration, the secondary portable container operably configured to seat on the lid of the selectively removable wall portable container assembly in a retained stacked assembly configuration.

8. The selectively removable wall portable container assembly according to claim 1, further comprising:

a polymeric gasket enclosing the enclosed opening defined on the sidewall.

9. A method of providing selective access to a portable container and stackable container assembly comprising the steps of:

providing a portable container body with a lid, the container body having a bottom wall and a sidewall coupled to, extending upwardly away from, and enclosing the bottom wall, the bottom wall and sidewall defining a container cavity, the sidewall defining a front opening on a front end thereof that is spatially coupled to the container cavity and the sidewall having a selectively removable sidewall portion superimposing the front opening and with an upper end and defining a sidewall portion length separating two opposing ends of the selectively removable sidewall portion, and the sidewall defining an enclosed opening thereon sized and shaped to receive a sidewall portion thickness defined by the sidewall portion;

coupling the lid with an upper end of the sidewall in a retained configuration to encapsulate the container cavity and to entirely cover the upper end of the selectively removable sidewall portion along the sidewall portion length ; and translating, after the coupling of the lid with the upper end of the sidewall and while in the retained configuration, the sidewall portion along a sidewall translation path and through the enclosed opening to expose the front opening of the sidewall.

10. The method according to claim 9, wherein:

the sidewall of the container body includes a left side, a right side opposing the left side, a longitudinal length separating the left and right sides of the sidewall, a rear end separating the front end of the sidewall, an upper end, and a sidewall height spanning from the bottom wall to the upper end of the sidewall, the sidewall portion having a sidewall portion length separating opposing side ends thereon and substantially spanning the longitudinal length and a sidewall portion height separating opposing upper and lower ends thereon and substantially spanning the sidewall height.

11. The method according to claim 10, wherein the front opening substantially spans the longitudinal length of the sidewall and further comprising:

translating the sidewall portion along a sidewall translation path to expose the entire front opening of the sidewall.

12. The method according to claim 11, wherein a method of providing selective access to a portable container and stackable container assembly further comprising the steps of:

providing a secondary portable container body;

coupling a secondary lid onto the secondary portable container body in the retained configuration; and coupling the secondary portable container body in the retained configuration to the lid of the portable body in a seated configuration.

13. The method according to claim 9, further comprising:

providing a polymeric gasket enclosing the enclosed opening defined on the sidewall of the portable container body and translating, after the coupling of the lid with the upper end of the sidewall and while in the retained configuration, the sidewall portion along the sidewall translation path and through the polymeric gasket enclosing the enclosed opening.

* * * * *